US006463673B1

(12) United States Patent
Gherna

(10) Patent No.: US 6,463,673 B1
(45) Date of Patent: Oct. 15, 2002

(54) METHOD AND APPARATUS FOR DRYER VENT HOSE CONNECTION

(76) Inventor: John F. Gherna, 820 S. 12'th St., Canon City, CO (US) 81212

( * ) Notice: Subject to any disclaimer, the term of this patent is extended or adjusted under 35 U.S.C. 154(b) by 22 days.

(21) Appl. No.: 09/840,063

(22) Filed: Apr. 23, 2001

(51) Int. Cl.[7] ..... F26B 25/06
(52) U.S. Cl. ..... 34/235; 34/140; 285/235
(58) Field of Search ..... 34/235, 140, 175, 34/606, 134; 285/223, 235, 424; 454/339, 903

(56) References Cited

U.S. PATENT DOCUMENTS 3,647,247 A * 3/1972 Pintard et al. ..... 138/119
3,811,714 A * 5/1974 Pintard ..... 285/229
5,318,328 A * 6/1994 Dawson ..... 285/148.2
5,476,183 A * 12/1995 Harpenau ..... 137/360
5,584,129 A * 12/1996 Williamson ..... 34/134
6,195,910 B1 * 3/2001 Robineau ..... 34/235
6,230,418 B1 * 5/2001 Gomulinski ..... 285/181
6,370,794 B1 * 4/2002 Tuggle ..... 285/147.1

* cited by examiner

*Primary Examiner*—Jiping Lu
(74) *Attorney, Agent, or Firm*—G. F. Gallinger

(57) ABSTRACT

A quicker, safer, more reliable and more convenient way of connecting a dryer to an exhaust pipe extending from a wall therebehind is disclosed. An apparatus to facilitate connection of a dryer having an vent pipe extending from a rear side portion thereof, to an exhaust pipe extending outwardly from a wall, comprises: a pan portion having a bottom side portion having a peripheral edge portion and a lateral sidewall connected around and extending away from the peripheral edge portion and an inner side of the bottom portion; the lateral sidewall adapted to laterally and resiliently compress; and, a short tubular section having one end portion adapted to fit closely together with the dryer vent pipe, and an opposite end portion extending through and connected to the outer side of the bottom portion of the pan portion. A method of connecting a vent pipe on a dryer to an exhaust pipe in a wall comprises the following steps: providing a connection apparatus as described above; closely fitting the short tubular section around the dryer vent pipe; and, pushing the dryer rearwardly against the wall axially compressing the sidewall around the exhaust pipe therein.

14 Claims, 1 Drawing Sheet

METHOD AND APPARATUS FOR DRYER VENT HOSE CONNECTION

FIELD OF THE INVENTION

This invention relates to the attachment of clothes dryers to exhaust pipes positioned behind the dryer within a framed wall. More particularly this invention relates to a quick, reliable and convenient method and apparatus for connecting a dryer to an exhaust pipe in a wall, behind the dryer.

BACKGROUND OF THE INVENTION

According to both Fridgidaire and Amana Company representatives more than 50% of service work on dryers relates to vent problems. Dryers are typically connected to a dryer exhaust pipe in the wall behind them with a short length of flexible and elongating hose. A typical hose comprises a spiralling wire which is tightly covered with a plastic tube. One end of the hose is received over a vent pipe perpendicularly extending from the rear side portion of the dryer. The other end of the hose is received over and tightened on the exhaust pipe extending perpendicularly from the wall behind the dryer. Both ends of the hose must be squeezed and banded around the pipes to maintain their position on the pipes and prevent air leakage.

One source of problems is that the vent pipe in the dryer does not usually axially align with the exhaust pipe in the wall. The pipes are typically 4" in diameter and consequently, the dryer should be spaced more than 4" from the wall if the hose is required to run along the wall between the dryer and the wall. Most homeowners find such a large spacing unacceptable.

Another source of problems is lack of side access to the rear of the dryer. This commonly occurs when the dryer is positioned in a lateral space nominally wider than the dryer; for example when the dryer is positioned between cabinets or alongside another appliance such as a washing machine. When in this common arrangement, it is necessary to space the dryer about 3" away from the wall and then jump over the dryer or counter into the space behind the dryer to connect and band both ends of the elongating hose. When the dryer is pushed back between the counters, the 3" length of hose may twist and bend, largely cutting off airflow therethrough. The dryer hose may be similarly twisted when the dryer is partially removed and replaced for cleaning or repair.

A dryer hose may also be partially closed if it is misaligned or pulled over an electrical supply cord. Whenever a dryer hose is partially closed there is an increased risk of fire. There is also a loss of drying efficiency. A quicker, more reliable and convenient method of connoting a dryer to the exhaust pipe is needed.

OBJECTS OF THE INVENTION

It is an object of this invention to disclose a quicker, safer, more reliable and more convenient way of connecting a dryer to an exhaust pipe extending from a wall therebehind. It is an object of this invention to disclose a method and apparatus which will eliminate the problem of a dryer hose twisting or otherwise being squeezed so that airflow therethrough is partially or substantially reduced thereby reducing dryer efficiency and possibly causing fire. It is yet a further object of this invention to disclose an apparatus and method which will allow a dryer to be connected to a dryer pipe in a wall therebehind when the two pipes are substantially out of axial alignment, without requiring the dryer to be substantially spaced from the wall. It is yet a further object of this invention to disclose an apparatus and method which will facilitate cleaning around and repair of a dryer particularly when the dryer is closely spaced between cabinets or other appliances. It is a final object of this invention to disclose an apparatus and method which will substantially reduce the number of service calls required by dryer owners.

One aspect of this invention provides for an apparatus to facilitate connection of a dryer having an vent pipe extending from a rear side portion thereof, to an exhaust pipe extending outwardly from a wall, comprising: a pan portion having a bottom side portion having a peripheral edge portion and a lateral sidewall connected around and extending away from the peripheral edge portion and an inner side of the bottom portion; said lateral sidewall adapted to laterally and resiliently compress; and, a short tubular section having one end portion adapted to fit closely together with the dryer vent pipe, and an opposite end portion extending through and connected to the outer side of the bottom portion of the pan portion. When the short tubular section is fitted closely around the dryer vent pipe, the dryer may be pushed rearwardly laterally and resiliently compressing the sidewall of the pan portion against the wall surrounding the exhaust pipe therein.

A method of connecting a vent pipe on a dryer to an exhaust pipe in a wall comprises the following steps: providing a connection apparatus as described above; closely fitting the short tubular section around the dryer vent pipe; and, pushing the dryer rearwardly against the wall axially compressing the sidewall around the exhaust pipe therein. A preferred method additionally provides the step of axially twisting the apparatus on the dryer vent pipe to ensure the enclosure of the exhaust pipe in the wall when the dryer is pushed rearwardly; and, screwing the apparatus to the dryer to ensure connection thereto in correct position is maintained.

Various other objects, advantages and features of this invention will become apparent to those skilled in the art from the following description in conjunction with the accompanying drawings.

FIGURES OF THE INVENTION

Figure 1:
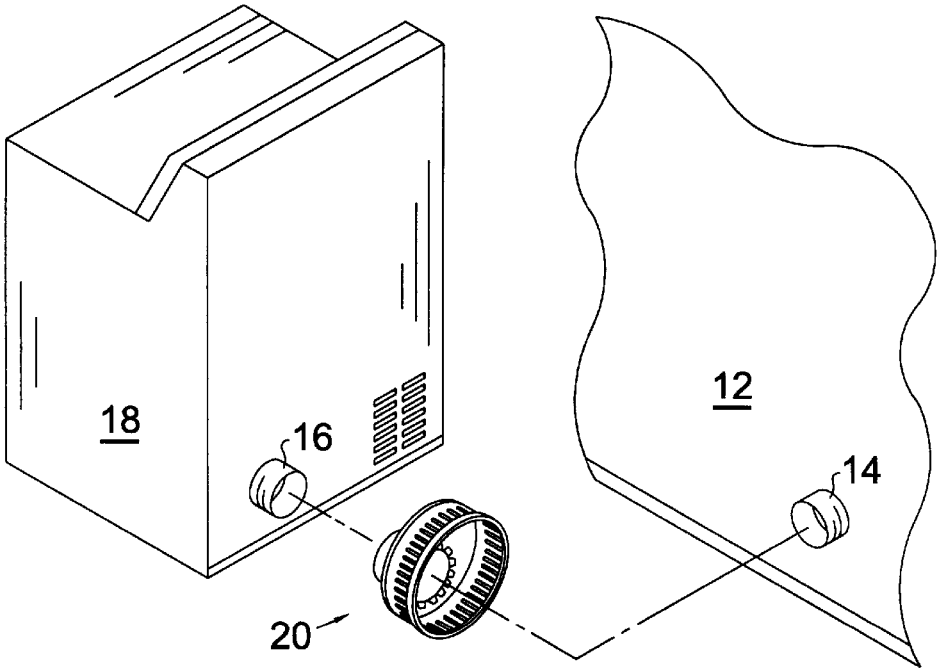
FIG. 1 is a perspective view of a dryer fitted with a dryer hose connection apparatus.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
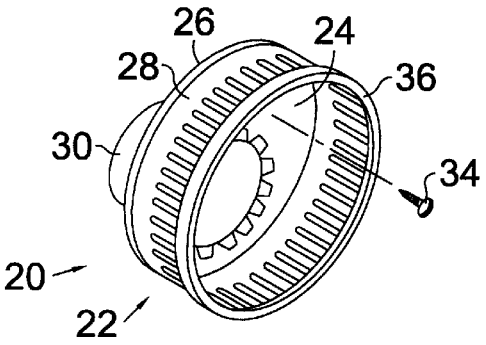
FIG. 2 is an enlarged perspective view of the circular dryer hose connection apparatus shown in FIG. 1.

Turning now to the drawings and more particularly to FIG. 1 we have a perspective view of an apparatus 20 to facilitate connection of a dryer 18 having a vent pipe 16 extending from a rear side portion thereof, to an exhaust pipe 14 extending outwardly from a wall 12. FIG. 2, an enlarged perspective view of the circular dryer hose connection apparatus 20 shown in FIG. 1 comprises a pan portion 22 having a bottom side portion 24 having a peripheral edge portion 26 and a lateral sidewall 28 connected around and extending away from the peripheral edge portion 26 and an inner side of the bottom portion 24. The lateral sidewall 28 is adapted to laterally and resiliently compress. The apparatus 20 also comprises a short tubular section 30 has one end portion adapted to fit closely together with the dryer vent pipe 16, and an opposite end portion extending through and connected to the outer side of the bottom portion 24 of the pan portion 22. When the short tubular section 30 is fitted closely around the dryer vent pipe 16, the dryer 18 may be pushed rearwardly, laterally and resiliently compressing the sidewall 28 of the pan portion 22 against the wall 12 surrounding the exhaust pipe therein.

Most preferably the short tubular section 30 is adapted to fit around an outside of the dryer vent pipe 16. In the apparatus 20 shown in FIGS. 1 and 2 the bottom pan portion 24 has a circular peripheral edge portion. Also, the short tubular section 30 is axially eccentric to the circular wall portion 28 thereof to better accomodate axial misalignment between the vent pipe 16 on the dryer 18 and the exhaust pipe 14 in the wall 12. In the embodiment of the circular apparatus 20 shown in FIG. 2 the apparatus is substantially made from sheet metal and the lateral sidewall 28 comprises a resiliently compressible plastic outer portion 30.

Figure 3:
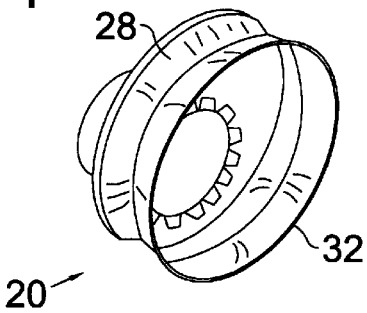
FIG. 3 is an enlarged perspective view of an alternative embodiment of the circular dryer hose connection apparatus having axially collapsible sidewalls.

FIG. 3 is an enlarged perspective view of an alternative embodiment of the circular dryer hose connection apparatus 20 having axially collapsible sidewalls 28. In this embodiment the entire lateral sidewall 28 is substantially laterally compressible. The pan portion 22 and tubular section 30 are integrally formed from plastic. The plastic is semi rigid and the lateral sidewall 28 which is compressible comprises a rib 32 therearound.

Figure 4:
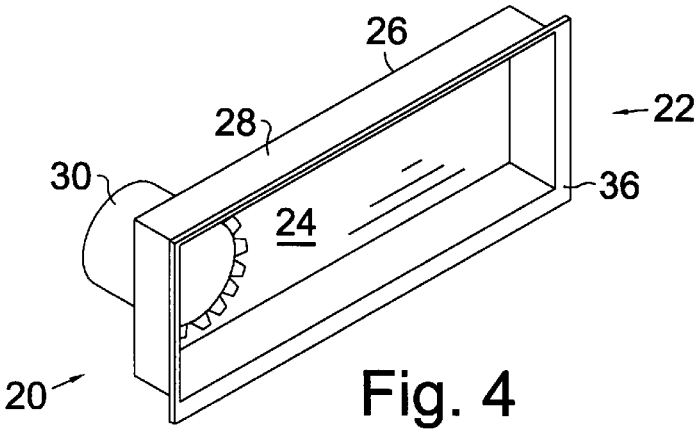
FIG. 4 is a perspective view of a rectangular dryer hose connection apparatus designed to accomodate substantial axial misalignment between the dryer vent and the wall exhaust pipes.

FIG. 4 is a perspective view of a rectangular dryer hose connection apparatus 20 designed to accomodate substantial axial misalignment between the dryer vent pipe 16 and the wall exhaust pipe 14. In this embodiment, the bottom pan portion 22 has a rectangular peripheral edge portion. In this embodiment, as in the circular embodiment of the apparatus 20, the pan portion 22 and tubular section 30 may either be made from sheet metal or alternatively integrally formed from plastic.

A method of connecting a vent pipe 16 on a dryer 18 to an exhaust pipe 14 in a wall 12 comprises the following steps: providing a connection apparatus 20 as described above; closely fitting the short tubular section 30 thereof around the dryer vent pipe 16; and, pushing the dryer 18 rearwardly against the wall 12 axially compressing the sidewall 28 of the apparatus 20 around the exhaust pipe 14 therein. The method may further comprise the step of axially twisting the apparatus 20 on the dryer vent pipe 16 to ensure the enclosure of the exhaust pipe 14 in the wall 12 when the dryer 18 is pushed rearwardly. Additionally the step of screwing 34 the apparatus 20 to the dryer 18 may be undertaken. This step is undertaken to ensure that the correct position of the connection is maintained.

While the invention has been described with preferred specific embodiments thereof, it will be understood that this description is intended to illustrate. and not to limit the scope of the invention, which is defined by the following claims.

I claim:

1. An apparatus to facilitate connection of a dryer having a vent pipe extending from a rear side portion thereof, to an exhaust pipe extending outwardly from a wall, comprising:

a pan portion having a bottom side portion having a peripheral edge portion and a lateral sidewall connected around and extending away from the peripheral edge portion and an inner side of the bottom portion;

said lateral sidewall adapted to laterally and resiliently compress; and, a short tubular section having one end portion adapted to fit closely together with the dryer vent pipe, and an opposite end portion extending through and connected to the outer side of the bottom portion of the pan portion;

so that when the short tubular section is fitted closely around the dryer vent pipe, the dryer may be pushed rearwardly laterally and resiliently compressing the sidewall of the pan portion against the wall surrounding the exhaust pipe therein.

2. An apparatus as in claim 1 wherein the short tubular section is adapted to fit around an outside of the dryer vent pipe.

3. An apparatus as in claim 1 wherein the bottom pan portion has a circular peripheral edge portion.

4. An apparatus as in claim 3 wherein the short tubular section is eccentric to the circular wall portion thereof to better accomodate axial misalignment between the vent pipe on the dryer and the exhaust pipe in the wall.

5. An apparatus as in claim 1 wherein the bottom pan portion has a rectangular peripheral edge portion.

6. An apparatus as in claim 5 wherein the short tubular section is connected to one end portion of the rectangular bottom portion of the pan so that connection of the dryer vent and wall exhaust pipes may be facilitated when they are substantially out of axial alignment.

7. An apparatus as in claim 1 wherein the lateral sidewall comprises a resiliently compressible plastic outer portion.

8. An apparatus as in claim 1 wherein the entire lateral sidewall is substantially laterally compressible.

9. An apparatus as in claim 1 wherein the pan portion and tubular section are formed from sheet metal.

10. An apparatus as in claim 1 wherein the pan portion and tubular section are integrally formed from plastic.

11. An apparatus as in claim 10 wherein the plastic is semi rigid and wherein the lateral sidewall is compressible and comprises a rib therearound.

12. A method of connecting a vent pipe on a dryer to an exhaust pipe in a wall comprises the following steps:

providing a connection apparatus having a pan portion having a bottom side portion having a peripheral edge portion and a lateral sidewall connected around and extending away from the peripheral edge portion and an inner side of the bottom portion, said lateral sidewall adapted to laterally and resiliently compress; and, a short tubular section having one end portion adapted to fit closely together with the dryer vent pipe, and an opposite end portion extending through and connected to the outer side of the bottom portion of the pan portion;

closely fitting the short tubular section around the dryer vent pipe; and, pushing the dryer rearwardly against the wall axially compressing the sidewall around the exhaust pipe therein.

13. A method as in claim 12 further comprising the step of axially twisting the apparatus on the dryer vent pipe to ensure the enclosure of the exhaust pipe in the wall when the dryer is pushed rearwardly.

14. A method as in claim 13 further comprising the step of screwing the apparatus to the dryer to ensure connection thereto in correct position is maintained.

* * * * *